US006419812B1

(12) United States Patent
Beck et al.

(10) Patent No.: US 6,419,812 B1
(45) Date of Patent: Jul. 16, 2002

(54) ALUMINUM LOW TEMPERATURE SMELTING CELL METAL COLLECTION

(75) Inventors: Theodore R. Beck; Craig W. Brown, both of Seattle, WA (US)

(73) Assignee: Northwest Aluminum Technologies, Seattle, WA (US)

( * ) Notice: Subject to any disclaimer, the term of this patent is extended or adjusted under 35 U.S.C. 154(b) by 0 days.

(21) Appl. No.: 09/721,723

(22) Filed: Nov. 27, 2000

(51) Int. Cl.[7] ..... C25C 3/16

(52) U.S. Cl. ..... 205/374; 205/376; 205/378; 205/380; 205/386; 205/387; 205/394; 205/395; 205/396

(58) Field of Search ..... 205/374, 376, 205/378, 380, 386, 387, 394, 395, 396

(56) References Cited

U.S. PATENT DOCUMENTS

| | | | | |
|---|---|---|---|---|
| 3,499,831 A | | 3/1970 | McMinn et al. | 204/243 |
| 3,578,580 A | | 5/1971 | Schmidt-Hatting et al. | 204/243 |
| 4,194,959 A | | 3/1980 | Hudson et al. | 204/243 |
| 4,392,925 A | | 7/1983 | Alder et al. | 204/67 |
| 4,399,008 A | | 8/1983 | Ray | 204/67 |
| 4,460,440 A | | 7/1984 | McGeer | 204/67 |
| 4,529,494 A | | 7/1985 | Joó et al. | 204/290 |
| 4,592,812 A | | 6/1986 | Beck et al. | 204/67 |
| 4,620,905 A | | 11/1986 | Tarcy et al. | 204/64 |
| 4,737,247 A | | 4/1988 | Jarrett et al. | 204/67 |
| 4,795,540 A | | 1/1989 | Townsend | 204/243 |
| 4,865,701 A | | 9/1989 | Beck et al. | 204/67 |
| 4,871,438 A | | 10/1989 | Marschman et al. | 204/291 |
| 4,999,097 A | | 3/1991 | Sadoway | 204/243 |
| 5,006,209 A | | 4/1991 | Beck et al. | 204/67 |
| 5,069,771 A | | 12/1991 | Nguyen et al. | 204/292 |
| 5,284,562 A | * | 2/1994 | Beck et al. | 204/243.1 |
| 5,409,580 A | | 4/1995 | Gesing et al. | 204/67 |
| 5,415,742 A | | 5/1995 | LaCamera et al. | 204/1.11 |

* cited by examiner

*Primary Examiner*—Bruce F. Bell
(74) *Attorney, Agent, or Firm*—Andrew Alexander

(57) ABSTRACT

A method of producing aluminum in an electrolytic cell containing alumina dissolved in an electrolyte. The method comprises the steps of providing a molten salt electrolyte in an electrolytic cell having an anodic liner for containing the electrolyte, the liner having an anodic bottom and walls including at least one end wall extending upwardly from the anodic bottom, the anodic liner being substantially inert with respect to the molten electrolyte. A plurality of non-consumable anodes is provided and disposed vertically in the electrolyte. A plurality of cathodes is disposed vertically in the electrolyte in alternating relationship with the anodes. The anodes are electrically connected to the anodic liner. An electric current is passed through the anodic liner to the anodes, through the electrolyte to the cathodes, and aluminum is deposited on said cathodes. Oxygen bubbles are generated at the anodes and the anodic liner, the bubbles stirring the electrolyte. Molten aluminum is collected from the cathodes into a tubular member positioned underneath the cathodes. The tubular member is in liquid communication with each cathode to collect the molten aluminum therefrom while excluding electrolyte. Molten aluminum is delivered through the tubular member to a molten aluminum reservoir located substantially opposite the anodes and cathodes. The molten aluminum is collected from the cathodes and delivered to the reservoir while avoiding contact of the molten aluminum with the anodic bottom.

38 Claims, 5 Drawing Sheets

ALUMINUM LOW TEMPERATURE SMELTING CELL METAL COLLECTION

The invention embodied in the subject matter described herein was made during work financed by the following government contract: Department of Energy Office of Industrial Technologies Contract #DE-FC07-98ID13662.

BACKGROUND OF THE INVENTION

This invention relates to aluminum electrolytic smelting cells and more particularly, it relates to collection and removal of molten aluminum from low temperature electrolytic cells for producing aluminum from alumina.

The use of low temperature (less than about 900° C.) electrolytic cells for producing aluminum from alumina have great appeal because they are less corrosive to cermet or metal anodes and other materials comprising the cell. The Hall-Heroult process, by comparison, operates at temperatures of about 950° C. This results in higher alumina solubility but also results in greater corrosion problems. Also, in the Hall-Heroult process, the carbon anodes are consumed during the process and must be replaced on a regular basis. In the low temperature cells, non-consumable anodes are used and such anodes evolve oxygen instead of carbon dioxide which is produced by the carbon anodes.

Non-consumable anodes are described in U.S. Pat. No. 5,284,562, incorporated herein by reference. That is, U.S. Pat. No. 5,284,562 discloses an oxidation resistant, non-consumable anode for use in the electrolytic reduction of alumina to aluminum, the anode having a composition comprising copper, nickel and iron. The anode is part of an electrolytic reduction cell comprising a vessel having an interior lined with metal which has the same composition as the anode. The electrolyte is preferably composed of a eutectic of $AlF_3$and either (a) NaF or (b) primarily NaF with some of the NaF replaced by an equivalent molar amount of KF or KF and LiF.

Other compositions for inert anodes are described in U.S. Pats. No. 4,399,008; 4,529,494; 4,620,905; 4,871,438; 4,999,097; 5,006,209; 5,069,771 and 5,415,742.

In U.S. Pat. No. 5,006,209, it is disclosed that finely divided particles of alumina are electrolytically reduced to aluminum in an electrolytic reduction vessel having a plurality of vertically disposed, non-consumable anodes and a plurality of vertically disposed, dimensionally stable cathodes in closely spaced, alternating arrangement with the anodes. A horizontally disposed gas bubble generator is located at the vessel bottom, underlying the cathodes and the spaces between each pair of adjacent electrodes. The vessel contains a molten electrolyte bath composed of (1) NaF+$AlF_3$eutectic, (2) KF+$AlF_3$eutectic and mixtures thereof, and in some cases (3) LiF. The alumina particles are maintained in suspension in the molten electrolyte bath by rising gas bubbles generated at the anodes and at the gas bubble generator, anodic liner, or anodic liner during the reduction process. However, having an anode located as the cell bottom is not without problems. In such cell, molten aluminum contacting the bottom anode becomes oxidized to aluminum oxide, interfering with the efficiency of the cell.

It will be appreciated that the low temperature cells have a lower solubility of alumina. Thus, excess alumina is provided in the electrolyte to insure a ready source of alumina. U.S. Pat. No. 5,006,209 discloses the use of gas bubbles generated at the anode to maintain the excess alumina particles in suspension. Thus, it will be seen that there is still a need to provide a bottom anode to produce gas bubbles. However, the use of a bottom anode interferes with collecting or removing aluminum produced in the cell.

There have been many different approaches to removing aluminum from an electrolytic cell. For example, U.S. Pat. No. 3,578,580 discloses a multi cell furnace in which are mounted two bipolar electrodes 16, each of which is composed of an oxygen-ion conducting layer 17, a porous anode 18, the porosity of which is represented by a duct 19, and a cathode 20. The cathode consists for example of graphite or amorphous carbon in the form of calcined blocks or of some other electron conducting material which is resistant to the fused melt, such as titanium carbide, zirconium carbide, tantalum carbide or niobium carbide. The aluminum is separated at the cathodes and drops into collecting channels 21.

U.S. Pat. No. 4,795,540 discloses an electrolytic reduction cell for the production of aluminum having a slotted cathode collector bar. The slots are filled with insulating material thereby directing the electrical current flow through the cathode collector bar in a manner which reduces the horizontal current components in the cell.

U.S. Pat. No. 3,499,831 discloses a current collector pin adapted to be electrically connected to a graphite cathode block in an electrolytic cell, such as an alumina reduction cell, by inseltion into a socket in the block, comprising a tubular copper conductive member surrounding and in contact with a central reinforcing metal core extending therethrough, and an outer sleeve surrounding and extending over the portion of the length of the tubular member not inserted into the socket.

U.S. Pat. No. 4,194,959 discloses an electrolytic reduction cell for the production of aluminum having current collector bars running across the floor of the cell unitarily or in separate sections. Deformation of the molten metal/electrolytic bath interface is reduced by leading current out of the collector bars or bar sections at positions remote from their ends by connector bars connected to said positions.

U.S. Pat. No. 4,392,925 discloses that the durability of oxide-ceramic anodes can be increased, if the aluminum surface which lies opposite the active anode surface and is in direct contact with the molten electrolyte, is smaller than the active anode surface. The separated aluminum is collected on the floor of the carbon lining and is sub-divided by an insulating material into pools, which are connected together by means of tubes or channels. The total of all the aluminum surfaces exposed to the melt amounts to 10–90% of the active anode surface. Further, it is noted that aluminum produced during electrolysis flows along the cathode as a film and is collected in an aluminum pool 38, arranged on the floor of the cell which communicates via pipes with an aluminum collection tank.

SUMMARY OF THE INVENTION

It is an object of this invention to provide a method for removing molten aluminum from an electrolytic cell used for producing aluminum from alumina.

It is another object of this invention to provide a method for removing aluminum from a low temperature cell for producing aluminum from alumina.

It is still another object of the invention to provide a process and apparatus for removing aluminum from an electrolytic cell employing a gas bubble generator or bottom anode for generating gas bubbles during operation of the electrolytic cell for producing aluminum from alumina.

It is yet another object of this invention to provide a process for removing aluminum from a low temperature electrolytic cell employing a bottom anode while avoiding contacting said anode with aluminum.

These and other objects will become apparent from a reading of the specification and claims appended hereto.

In accordance with these objects, there is provided a method of producing aluminum in an electrolytic cell containing alumina dissolved in an electrolyte. The method comprises the steps of providing a molten salt electrolyte in an electrolytic cell having an anodic liner for containing the electrolyte, the liner having an anodic bottom and walls including at least one end wall extending upwardly from the anodic bottom, the anodic liner being substantially inert with respect to the molten electrolyte. A plurality of non-consumable anodes is provided and disposed vertically in the electrolyte. A plurality of cathodes is disposed vertically in the electrolyte in alternating relationship with the anodes. The anodes are electrically connected to the anodic liner. An electric current is passed through the anodic liner to the anodes, through the electrolyte to the cathodes, and aluminum is deposited on said cathodes. Oxygen bubbles are generated at the anodes and the anodic liner, the bubbles stirring the electrolyte. Molten aluminum is collected from the cathodes into a tubular member positioned underneath the cathodes. The tubular member is in liquid aluminum communication with each cathode to collect the molten aluminum therefrom while excluding electrolyte. Molten aluminum is delivered through the tubular member to a molten aluminum reservoir located substantially opposite or adjacent the anodes and cathodes. The molten aluminum is collected from the cathodes and delivered to the reservoir while avoiding contact of the molten aluminum with the anodic bottom.

DETAILED DESCRIPTION OF THE PREFERRED EMBODIMENTS

Figure 1:
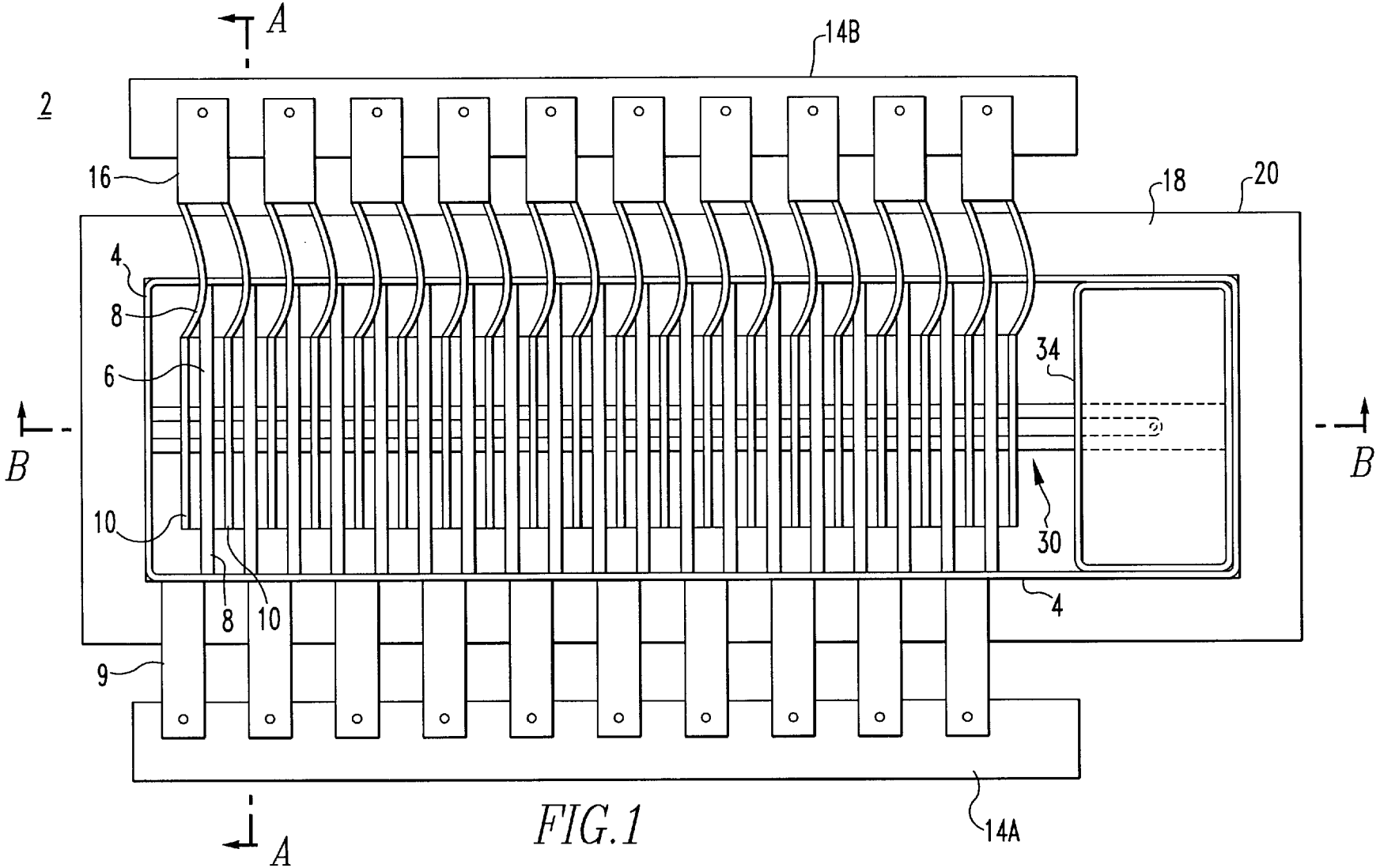
FIG. 1 is a plan view illustrating an embodiment of the invention which may be used in the practice of the invention.

In FIG. 1, there is shown a top or plan view of an embodiment of the invention which illustrates an electrolytic cell 2 for the electrolytic production of aluminum from alumina dissolved in an electrolyte contained in the cell. Cell 2 comprises a metal or alloy liner 4 having bottom and sides for containing electrolyte. Non-consumable or inert anode 6 is shown mounted vertically inside liner 4 which preferably has the same composition as anode 6. Further, as shown in FIG. 1, anode 6 is connected to liner 4 by means or straps 8 to provide an electrical connection therebetween. Also, liner 4 is shown connected to bus bar 14A by electrical conducting strap 9. Cathodes 10 are shown positioned on either side of anode 6. Cathodes 10 are electrically connected to bus bar 14B by appropriate connection means such as strap 16. Liner 4 is layered with thermal insulating material 18 such as insulating fire brick which is contained within a metal shell 20.

In operation, electrical current from bus bar 14A flows through from electrical strap 9 into anodic liner 4. Current from liner 4 flows through conducting straps 8 to anodes 6 and then through an electrolyte to cathodes 10. The current then flows from cathodes 10 along connection means 16 to a second bus bar 14B. Additional electrolytic cells may be connected in series on each side of cell 2.

While any inert anode including cermets or metal alloys may be used in the electrolytic cell of the invention, it is preferred that the anode material including the anodic liner be comprised of Cu—Ni—Fe compositions that have resistance to oxidation by the electrolyte. Suitable anode compositions are comprised of 25–70 wt. % Cu, 15–60 wt. % Ni and 1–30 wt. % Fe. Within this composition, a preferred anode composition is comprised of 45–70 wt. % Cu, 25–48 wt. % Ni and 2–17 wt. % Fe with typical compositions comprising 45–70 wt. % Cu, 28–42 wt. % Ni and 13–17 wt. % Fe.

It will be understood that a number of anodes and cathodes is employed with the anodes and cathodes are used in alternating relationship.

In the plan view in FIG. 1, there is shown a schematic of conduit 30 (see also FIGS. 2 and 3) for conveying molten aluminum from cathodes 10 to a molten aluminum reservoir 34. In FIG. 1, molten aluminum reservoir 34 is shown contained within liner 4. Thus, aluminum produced at cathodes is collected in conduit 30 and is conveyed to molten aluminum reservoir 34 for removal from the cell.

Figure 2:
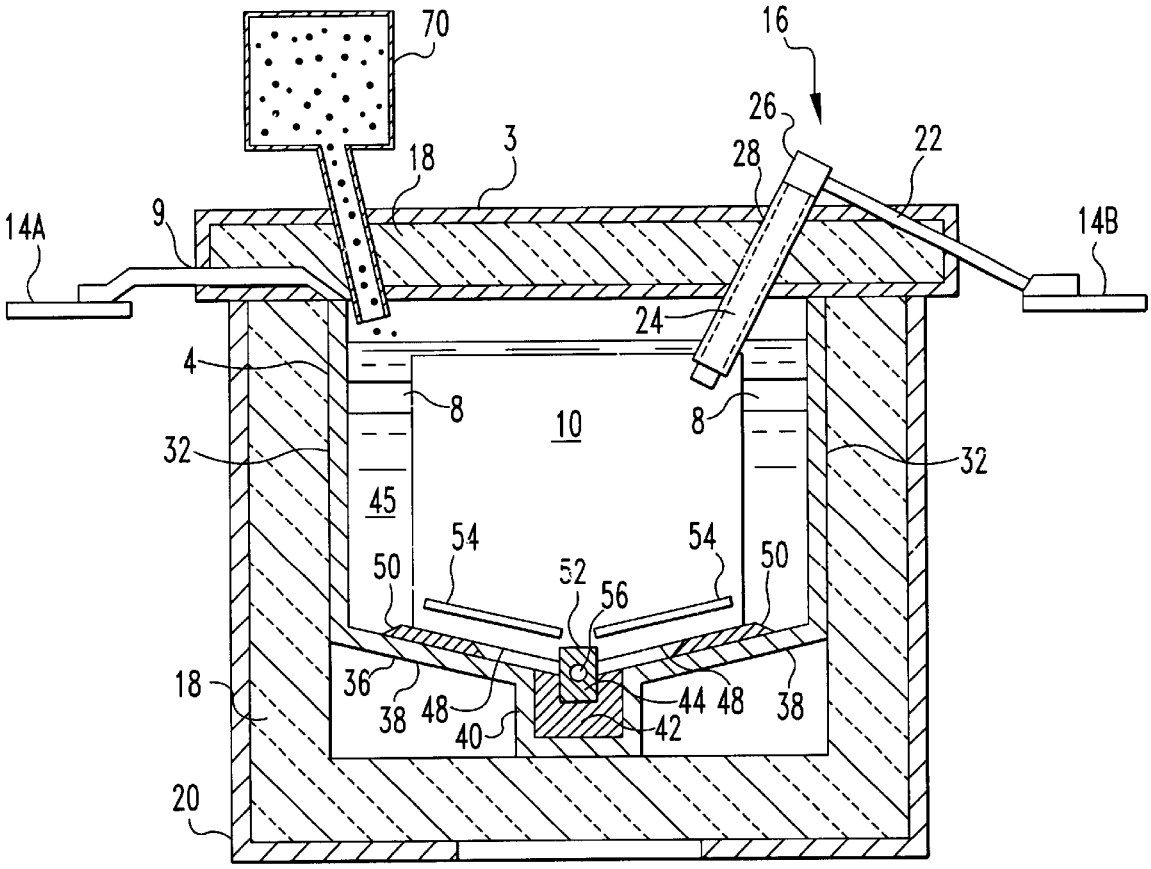
FIG. 2 is a cross-sectional view of an electrolytic cell along line A—A of FIG. 1.

FIG. 2 is a cross-sectional view along line A—A of FIG. 1 showing anodic liner 4, straps 8 connecting anodes to the liner, cathode 10, strap 9 connecting liner 4 to bus bar 14A and insulation 18 contained between anodic liner 4 and metal shell 20. Also, shown in FIG. 2 is electrical connection means 16 used to connect cathodes 10 to bus bar 14B. Connection means 16 may be comprised of a flexible metal strap 22 which is connected to bus bar 14B. Flexible metal strap 22 is connected to cathode 10 by collector bars 24 which are slotted on the bottom and straddle or fit over cathode 10. Strap 22 is connected to collector bar 24 utilizing an aluminum cap 26. That is, aluminum cap 26 is cast on collector bar 24 and strap 22 is welded thereto. Electrical connection between the cathode and collector bar may be provided by using aluminum metal at the connection. That is, aluminum metal becomes molten at operating temperature and wets both the cathode and collector bar, particularly if both cathode and collector bar are fabricated from titanium diboride. To guard against air burn of collector bar 24 during operation, a sleeve or tube of alumina 28 may be used to cover or surround collector bar 24.

Referring further to FIG. 2, it will be seen that anodic liner 4 has vertical sides 32 and bottom referred to generally as 36. Bottom 36 has two sides 38 which are contiguous with walls or sides 32. Sides 38 of bottom 36 are sloped downwardly towards a central trough or channel 40. Channel 40 is filled with an electrical insulating material 42, substantially non-reactive with bath or aluminum. Electrical insulating material 42 may be selected from alumina and boron nitride or other suitable non-reactive material. A tube 44 of refractory material, e.g., titanium diboride, is positioned in insulating material 42 to carry molten aluminum away from cathodes 10 to reservoir 34.

Cathodes 10 are shown positioned under surface 46 of electrolyte 45 and spaced substantially equally from sides 32 of liner 4. Cathodes 10 have a lower surface or edge 48 which rest on electrically insulating blocks 50 made from alumina or boron nitride, for example. Lower surface or edges 48 are shown positioned parallel to sides 38 of liner 4. Cathodes 10 terminate in a point or end 52 provided in slotted opening 58 in tube 44 (see FIG. 3). In operation of the cell, aluminum deposited on the cathode flows towards point or end 52 and into tube 44 from where it is removed to reservoir 34. Grooves 54 may be provided in cathode 10 to aid in the flow of molten aluminum on the cathode surface towards point or end 52 for purposes of collection.

Figure 3:
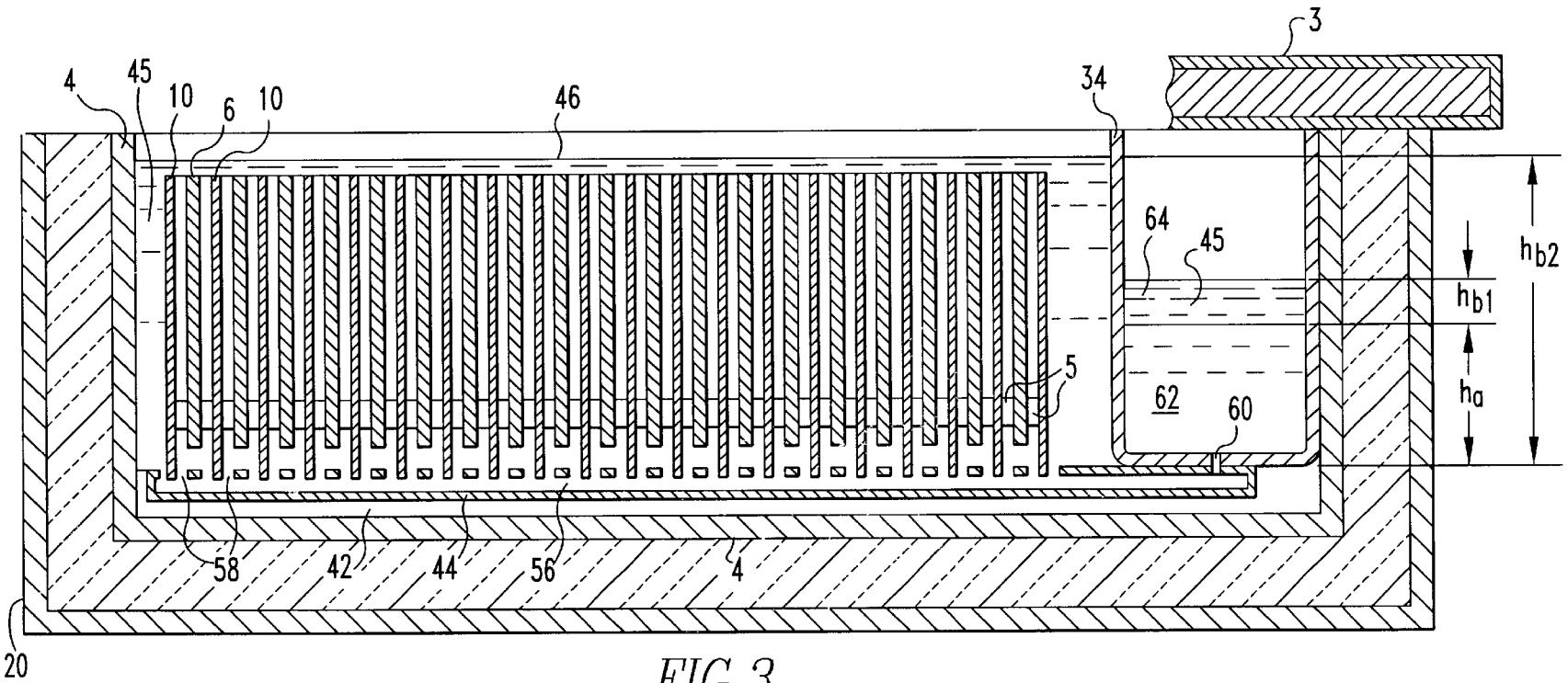
FIG. 3 is a cross-sectional view of an electrolytic cell along line B—B of FIG. 1.

FIG. 3 is a cross-sectional view along line B—B of FIG. 1 showing liner 4, anodes 6, cathodes 10, molten aluminum reservoir 34, and refractory tube 44 for transferring or carrying molten aluminum from cathodes 10 to molten aluminum reservoir 34. It will be noted that refractory tube 44 has a central bore 56 having slotted openings 58 therein approximate or adjacent cathodes 10. Openings 58 permit molten aluminum collected at the cathodes to pass into bore 56 and flow towards molten aluminum reservoir 34. Molten aluminum in bore 56 passes through opening 60 into molten aluminum reservoir 34 where a body 62 of molten aluminum collects therein. A layer 64 of electrolyte 45 may be provided on top of body 62 to protect against oxidation of molten aluminum with air. The head of electrolyte or bath contained by liner 4 forces aluminum from the cathodes into bore 56 and therefrom into reservoir 34. The aluminum produced is collected continuously from all the cathodes and directed to body 62 which is contained in an electrically insulated vessel or reservoir.

While not wishing to be bound by any theory of invention, the collection of body 62 of aluminum is explained as follows. That is, with reference to FIG. 3, there is shown the head of electrolyte in cell 2. Also shown is the head of aluminum in reservoir 34. The top of tube 44 is used as the reference plane. The head of electrolyte in cell 2 is denoted as hb1 and the total head in collection vessel or reservoir 34 is denoted as $h_a+h_{b2}$. The pressure from the heads $h_a+h_{b2}$ must be less than the pressure from the electrolyte or bath head $h_{b1}$ to prevent aluminum leaking out of joints or openings 58 between cathodes 10 and tube 44. This concept may be represented by the following formula:

$$h_{b1}\rho_{b1} \geqq h_{a\rho a}+h_{b2\rho b2} \qquad \text{Eq.(1)}$$

If equality is used in Eq.(1) and the following values are assumed, $h_{b1}$=45cm (i.e., 18 inch high cathodes)

$h_{b2}$=5cm $\rho_{b1}$=1.97 g/cm$^3$ $\rho_{b2}$=1.97 g/cm$^3$ $\rho_a$=2.36 g/cm$^3$ these values give $h_a$ (max.)=33 cm, or a total maximum head ($h_{b2}h_a$) in the collection vessel of 38 cm.

Aluminum 62 is removed from reservoir 34 by periodic siphoning. When the aluminum is tapped from collection vessel 34, the head difference between the bath and the vessel is 45–5=40cm. Bath then has to be excluded from tube 44 by interfacial tension of aluminum/bath in slots or openings 58 between the cathodes 10 and tube 44. The width of slot or opening 58 can be calculated by:

$$t \leqq 2\gamma/\Delta h\rho g, \qquad \text{Eq.(2)}$$

where t is the width of opening 58

Using the following values:

$\gamma$=500 dyne/cm $\Delta h$=40 cm $\rho$=1.97 g/cm$^3$ g=980 dyne/gm gives t (max.)=0.013 cm (0.13 mm or 130 $\mu$m).

Thus, for a cell of this size, the width of opening 58 would have be on the order of 130 $\mu$m.

Figure 4A:
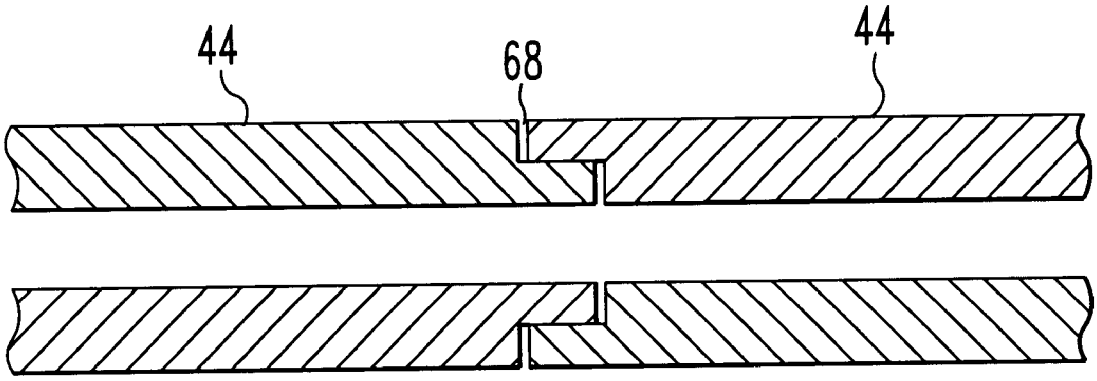
FIGS. 4A and 4B are cross-sectional views of a channel used for delivering molten aluminum.
Figure 4B:
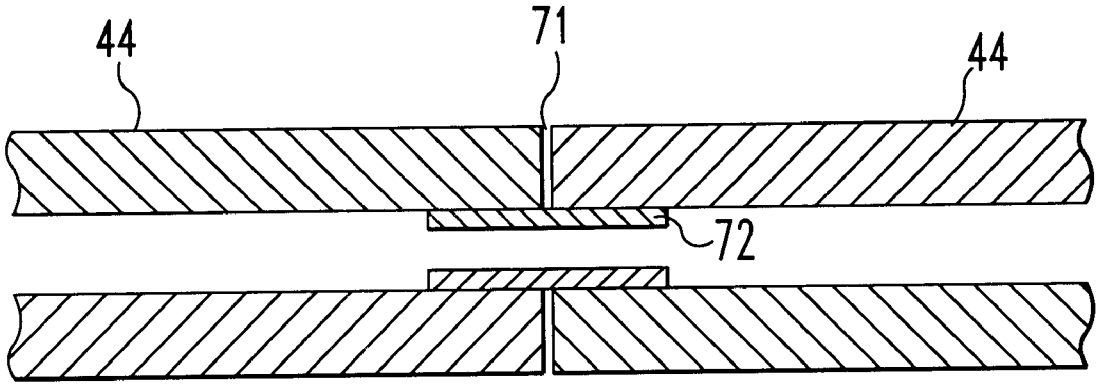

At the startup of a cell, there is a substantial increase in temperature. Thus, it may be necessary to accommodate the differential expansion between lining 4 and refractory tube 44. FIGS. 4A and 4B illustrates joints which may be used in conjunction with refractory tube 44. These joints permit differential expansion between lining 4 and refractory tube 44 during cell startup. It will be seen from FIG. 4A that refractory tube 44 is comprised of joints 68 where the one end of tube 44 fits into another part of tube 44. A space is provided at joint 68 to care for any differential expansion which may occur between lining 4 and refractory tube 44. In FIG. 4B, another type of joint is disclosed to accommodate differential expansion during startup of cell 2. That is, at joint 71, a tubular member 72 is provided inside refi-factory tube 44 overlapping joint 71 to ensure against leakage and yet provide for differential thermal expansion. Tubular member 72 may be comprised of the same or similar material as refractory tube 44.

Figure 5:
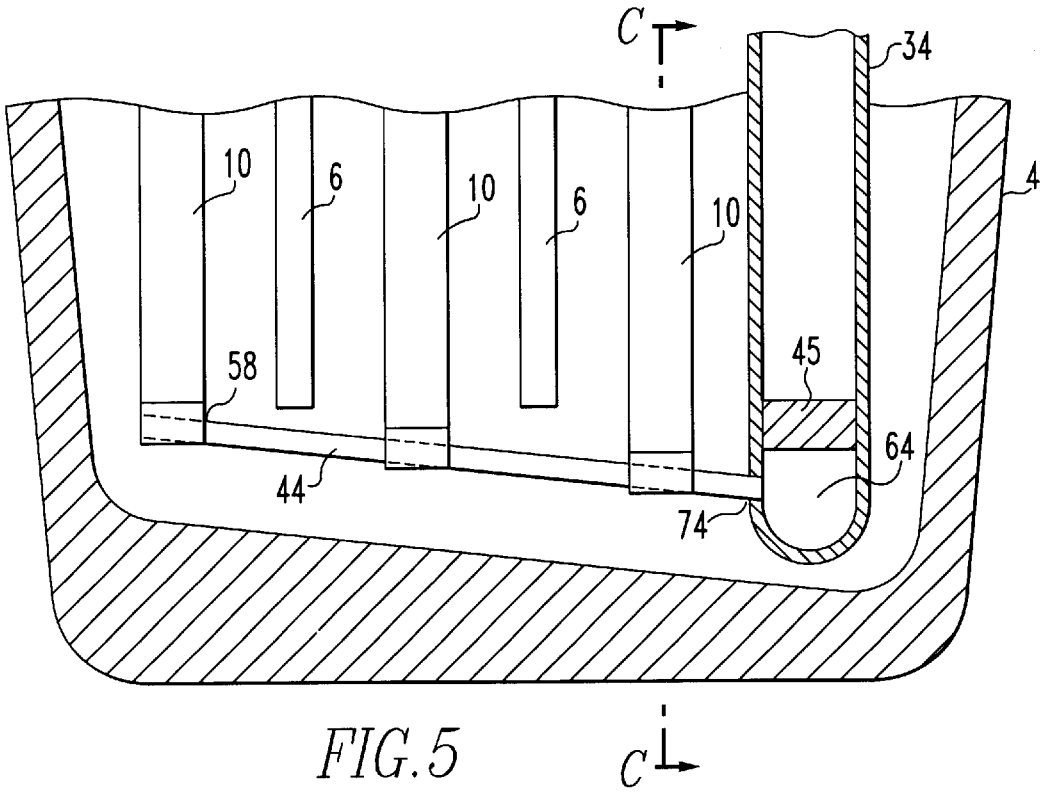
FIG. 5 is a cross-sectional view of an electrolytic test cell showing a conduit or collector in connection with cathodes for delivering molten metal to a reservoir.
Figure 6:
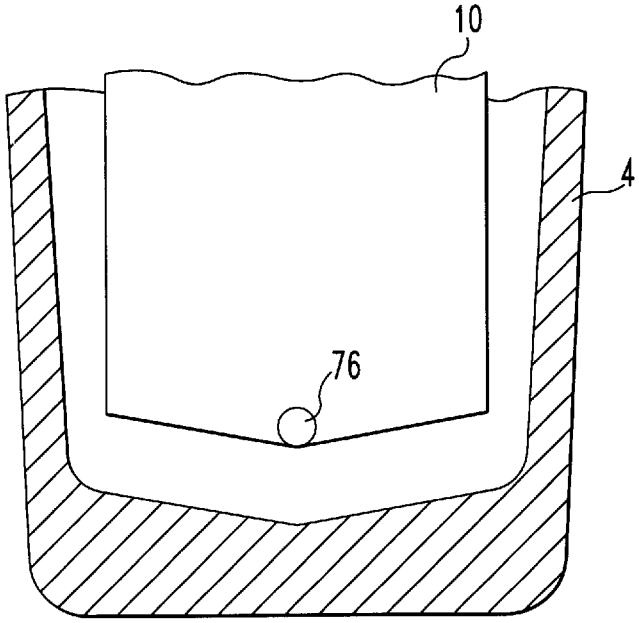
FIG. 6 is a view along line C—C of FIG. 5.

This invention was tested in a 300A cell having configuration similar to that shown in FIGS. 5 and 6 except for test purposes only a cathode was used with the anodic liner. In FIG. 5, the cell shown is comprised of anodic liner 4, anodes 6 and cathodes 10. A molybdenum tube 44 is passed through openings 76 in the bottom of cathodes 10 (see FIG. 6) and inserted into alumina reservoir 34. Openings or slits 58 are provided adjacent cathode faces to receive molten aluminum deposited at the cathode during cell operation. Opening 74 in alumina reservoir 34 is provided with less than 0.25 mm clearance for tube 44. It was found that if opening 74 was coated or sprayed with a material wettable with aluminum, e.g., molybdenum, a seal was facilitated to exclude bath. The openings 76 are shown in bottom of cathodes 10 in FIG. 6 which is a cross-sectional view along line C—C of FIG. 5. The cathodes are comprised of $TiB_2$and the anodes are comprised of Fe—Ni—Cu alloy. A layer of bath 45 is provided in reservoir 34 to avoid oxidation of molten aluminum 62. The electrolyte in cell 4 consist essentially of NaF:$AlF_3$eutectic, about 45 mol. % $AlF_3$and had 6 wt. % excess alumina dispersed therein. The cell was operated for 4–6 hours at a temperature of about 760° C. and a current of 100 amps. After operation, it was found that aluminum was collected in reservoir 34.

While reference herein has been made to $TiB_2$cathodes, it will be understood that the cathodes can be comprised of any suitable material that is substantially inert to the molten aluminum such as zirconium boride, molybdenum, titanium carbide, titanium and zirconium carbide.

The anode can be any non-consumable anode selected from cernet or metal alloy anodes inert to electrolyte at operating temperatures. The ceinmet is a mixture of metal such as copper and metal oxides and the metal alloy anode is substantially free of metal oxides. A preferred oxidation-resistant, non-consumable anode for use in the cell is comprised of iron, nickel and copper, and containing about 1 to 50 wt. % Fe, 15 to 50 wt. % Ni, the remainder consisting essentially of copper. A further preferred oxidation-resistant, non-consumable anode consists essentially of 1–30 wt. % Fe, 15–60 wt. % Ni and 25 to 70 wt. % Cu. Typical oxidation-resistant, non-consumable anodes can have compositions in the range of 2 to 17 wt. % Fe, 25 to 48 wt. % Ni and 45 to 70 wt. % Cu.

The electrolytic cell can have an operating temperature less than 900° C. and typically in the range of 660° C. (1220°

F.) to about 800° C. (1472° F.). Typically, the cell can employ electrolytes comprised of $NaF+AlF_3$eutectics, $KF+AlF_3$eutectic, and LiF. The electrolyte can contain 6 to 26 wt. % NaF, 7 to 33 wt. % KF, 1 to 6 wt. % LiF and 60 to 65 wt. % $AlF_3$. More broadly, the cell can use electrolytes that contain one or more alkali metal fluorides and at least one metal fluoride, e.g., aluminum, fluoride, and use a combination of fluorides as long as such baths or electrolytes operate at less than about 900° C. For example, the electrolyte can comprise NaF and $AlF_3$. That is, the bath can comprise 62 to 53 mol. % NaF and 38 to 47 mol. % $AlF_3$.

As noted, thermal insulation 18 is provided around liner 4. Also, a lid 3 shown in FIG. 2 is provided having insulation sufficient to ensure that the cell can be operated without a frozen crust and frozen sidewalls.

The vertical anodes and cathodes in the cell are spaced to provide an anode-cathode distance in the range of ¼ to 1 inch. Electrical insulative spacers 5 (FIG. 3) can be used to ensure maintenance of the desired distance between the anode and cathode. In addition, bottom edge 54 of cathode 10 should be maintained at a distance of about ¼ to 1 inch from bottom 38 of anode liner 4 in order to ensure adequate current density and gas evolution on the bottom to keep alumina suspended.

In the present invention, the anodes and cathodes have a combined active surface ratio in the range of 0.75 to 1.25.

In the low temperature electrolytic cell of the invention, alumina has a lower solubility level than in conventional Hall-type cells operated at a much higher temperature. Thus, in the present invention, solubility of alumina ranges from 2% to 4%, depending to some extent on the electrolyte and temperature used in the cell. To ensure against anode effect, an excess of alumina over solubility is maintained in the electrolyte. Thus, the cell can be operated with a sluny of alumina (undissolved alumina) in the electrolyte in the range of 1 to 30 wt. % with a preferred slurry containing undissolved alumina in the range of 5 to 10 wt. % alumina. Alumina can be added from hopper 70 (FIG. 2) to the space between electrodes and wall of sides 32 of liner 4. The alumina is added in an amount such that the density of the slurry does not exceed 2.3 g/cm$^3$, which is the density of molten aluminum.

During operation of the cell, oxygen is produced at the anode surfaces and bubbles upwardly through electrolyte slurry 45 and produces stirring in the cell. The stiffing resulting from the evolution of gas bubbles provides dissolution of alumina in the electrolyte and aids in maintaining saturation of dissolved alumina. The stirring also ensures a constant supply of dissolved alumina to the anode surface. Further, the gas bubbles maintain undissolved alumina particles in suspension in the cell and prevents or inhibits alumina particles from settling to the bottom of the cell. Thus, it will be seen that the anodic liner importantly contributes to evolution of gaseous bubbles to enhance the performance of the cell, and thus suspended alumina particles are maintained substantially uniformly distributed throughout the electrolyte. Bayer alumina particles are approximately 100 $\mu$m in diameter, but composed of an agglomeration of smaller particles. Ground alumina with 1 $\mu$m particles has been used in laboratory tests.

Alumina useful in the cell can be any alumina that is comprised of finely divided particles. Usually, the alumina has a particle size in the range of about 1 to 100 $\mu$m with a preferred size being in the range of 1 to 10 $\mu$m.

In the present invention, the cell can be operated at a current density in the range of 0.1 to 1 A/cm$^2$while the electrolyte is maintained at a temperature in the range of 660° to 800° C. A preferred current density is in the range of about 0.4 to 0.6 A/cm$^2$of anode surface. The lower melting point of the bath (compared to the Hall cell bath which is above 950° C.) permits the use of lower cell temperatures, e.g., 730° to 800° C., which increases current efficiency in the cell and reduces corrosion of the anodes and cathodes.

The following example is further illustrative of the invention.

EXAMPLE

An apparatus was used comprising the liner for a 300A cell and a single molybdenum (Mo) cathode. The apparatus was similar to that shown in FIGS. 5 and 6 except only a single cathode was used. The cathode was located beneath the electrolyte and was a flat plate, ⅛" (0.32 cm) thick, of rectangular cross section except at the bottom. The bottom edge was brought to a point in the center of the cross section (see FIG. 6), with the bottom edges at angles of about 7 degrees from horizontal. Under the electrolyte, this cathode plate measured 4" (10.2 cm) across, 4" (10.2 cm) high along each outside edge, and 4.25" (10.8 cm) height in the center (at the point). These two sloped-bottom edges meeting at the point had attached to them Mo tubing J(not shown in FIGS. 5 and 6). The tubing outside diameter (OD) was ¼" (0.64 cm), and the inside diameter (lD) was ⅛" (0.32 cm). Each piece was about 2.01" (5.1 cm) long. This tubing was slotted over each length such that the bottom edges of the cathode each resided within the corresponding piece of tubing, with a clearance between the side of the cathode and the closest edges of tubing meeting the criteria of Eq. (2). The two pieces of tubing were butted together at the bottom point of the cathode, where they met. A hole was provided in one side of these tubes to allow connection to another such tube of Mo of the same ID and OD, which passed from that face of the cathode perpendicularly to that face, and at an angle of about 15 degrees downward from horizontal. This served as the conveyance from the cathode to a collection chamber, and had a total length of 2" (5.1 cm).

The collection chamber comprised a length of closed-end round bottom alumina tubing. The chamber was situated such that it was about 1.5" (3.8 cm) from the face of the cathode. Thus, about ½ inch of the conveyance tube resided within the walls and internal space of this tubing.

The alumina tubing had an ID of 1⅜" (3.50 cm) and an OD of 1⅝" (4.13 cm). The curvature for the closest end began about 11⅜" (28.9 cm) from the open end, and the total length of the piece as 12" (30.5 cm). At a distance of about 11⅛"(28.3 cm) from the open end, a hole was centered in the tubing. This hole had a diameter of about 5/16" (0.80 cm). On the alumina circumference of this hole, and on the outside of the tubing around the hole in a roughly circular area of about 1" (2.54 cm) in diameter, Mo was applied by a flame-spray method. The flame-sprayed Mo was used to obtain an aluminum wetted surface. An aluminum wetted $TiB_2$ring insert may also be used. The conveyance tube was then placed to enter the chamber through this Mo-coated hole. The distance between the hole coating and the outer surface of the conveyance tube met the condition of Eq. 2. With this arrangement, the point of the cathode was about 1⅜" (3.50 cm) from the bottom of the anode liner of the cell while the bottom of the alumina tubing rested on the bottom of the anode liner, and the minimum distance from the bottom of the liner to any cathode metal (in particular, the lowest point of the flame-sprayed Mo) was about ⅝" (1.6 cm).

Because Mo oxidizes readily in air at elevated temperatures, the above assembly was lowered into already molten electrolyte prior to the electrolysis test described below. The anode liner holding the electrolyte, which was the only anode in this test, was of an investment cast 70:15:15 Cu:Ni:Fe alloy.

The electrolyte was about 45 mol. % aluminum fluoride ($AlF_3$) and 55 mol. % sodium fluoride (NaF). 3000g were used at an operating temperature of about 760° C. The electrolyte was maintained as a slurry with undissolved alumina, above saturation. The weight percent excess undissolved alumina was about 6%, and the alumina particle size was nominally one micron. Electrolysis was conducted at 100 amperes for a total of 5.1 hours in this test.

In this test, the cathode itself, conveyance tube and flame-sprayed Mo had been wetted with aluminum (A1) in a previous test. When the apparatus was inserted into the melt, the Al melted quickly and a liquid seal of aluminum was formed. A heated stainless steel siphon tube connected through a valve to a vacuum was inserted into the collection chamber to a depth about ½" (1.27 cm) above the top of the hole in the chamber.

After about one hour of electrolysis at 100 amperes, a length of tungsten (W) wire was inserted into the chamber until it touched the closed end at the bottom thereof. This was then pulled out and inspected; such procedure constituting a measurement of the depth of both A1 and electrolyte in the chamber. The A1 depth was determined to be 1.8" (4.6 cm), and the electrolyte layer above this appeared to be quite thin, about 0.04" (0.1 cm). This depth represented more Al than would be produced in the one hour of electrolysis, and included Al previously present on the cathode assembly.

After another 1.38 hours of continued electrolysis, the Al depth was measured again and found to be about 2.3" (5.8 cm) deep. The increase in depth corresponds to an addition of about 12.2 ml of liquid A1, which was about 28 g at 760° C. This volume Al corresponds to a current efficiency of 61%.

After an additional 3/4 hour, the Al depth had climbed only another 0.1"(0.25 cm).

Electrolysis was continued for an additional two hours with negligible increase in depth of A1.

After the test, a total of 119.8 g of A1 was recovered from the cathode and collection system, exclusive of the original amount, representing a current efficiency of about 60% based on this recovered metal. Of the total recovered, about 62 g was collected with the siphon. It was noted after shutdown that the region that had been sprayed with Mo now had a significant amount of the intermetallic material that had formed at the interface of A1 and Mo phases. This material is mushy at temperature and does not flow readily. It is believed that the reason the Al depth ceased to climb in the collection chamber after the measurement taken 1.38 hours into the test is that the mushy material impeded the free flow of liquid Al into the chamber.

This test showed that (a) the principles of Eq. (2) function to form an effective seal between the chamber and the electrolyte, (b) the liquid A1 formed on the cathode can be conveyed to a collection chamber driven by the difference in hydrostatic head at the bottom of the cathode and in the chamber, and (c) liquid A1 can be siphoned from such a chamber once it has collected there.

While the invention has been described in terms of preferred embodiments, the claims appended hereto are intended to encompass other embodiments which fall within the spirit of the invention.

What is claimed is:

1. A method of producing aluminum in an electrolytic cell containing alumina dissolved in an electrolyte, the method comprising the steps of:

(a) providing a molten salt electrolyte having alumina dissolved therein in an electrolytic cell having an anodic liner for containing said electrolyte, said liner having an anodic bottom and walls including at least one end wall extending upwardly from said bottom, said anodic liner being substantially inert with respect to said molten electrolyte;

(b) providing a plurality of non-consumable anodes disposed substantially vertically in said electrolyte and a plurality of cathodes disposed vertically in said electrolyte, said anodes and said cathodes arrange in alternating relationship, said anodes electrically connected to said anodic liner;

(c) passing an electric current through said anodic liner to said anodes, through said electrolyte to said cathodes, depositing aluminum on said cathodes, and generating oxygen bubbles at the anodes and said anodic liner, said bubbles stirring said electrolyte;

(d) collecting molten aluminum from said cathodes in a tubular member positioned underneath said cathodes, said tubular member in liquid communication with each cathode to collect said molten aluminum therefrom while excluding electrolyte; and (e) delivering molten aluminum through said tubular member to a molten aluminum reservoir located substantially opposite said anodes and cathodes, said molten aluminum collected from said cathodes and delivered to said reservoir while avoiding contact of the molten aluminum with said anodic bottom.

2. The method in accordance with claim 1 including maintaining 2 to 30 wt. % undissolved alumina particles in said electrolyte to provide a slurry therein.

3. The method in accordance with claim 2 wherein undissolved alumina has a particle size in the range of about 1 to 100 $\mu$m.

4. The method in accordance with claim 1 including operating said cell to maintain said electrolyte at a temperature less than 900° C.

5. The method in accordance with claim 1 including operating said cell to maintain said electrolyte in a temperature range of about 660° to 800° C.

6. The method in accordance with claim 1 including using an electrolyte comprised of one or more alkali metal fluorides.

7. The method in accordance with claim 1 wherein said anodes and anodic liner are comprised of an Ni—Cu—Fe alloy.

8. The method in accordance with claim 1 including passing an electric current through said cell at a current density in the range of 0.1 to 1.5 A/cm$^2$.

9. The method in accordance with claim 1 including using cathodes selected from the group consisting of titanium diboride, zirconium boride, titanium carbide, titanium and zirconium carbide.

10. The method in accordance with claim 1 wherein anodic bottom has two sides sloped downwardly towards said tubular member and said tubular member is insulated from said anodic bottom using an electrical insulating material substantially non-reactive with said molten electrolyte.

11. The method in accordance with claim 10 wherein said electrical insulating material is selected from the group consisting of alumina and boron nitride.

12. The method in accordance with claim 1 including disposing said tubular member substantially transverse to said cathodes.

13. The method in accordance with claim 1 wherein said tubular member is comprised of $TiB_2$.

14. The method in accordance with claim 1 including providing bottom edges on said cathodes slope downwardly towards a central portion of said cathode to direct molten aluminum into said tubular member.

15. The method in accordance with claim 14 including fitting said central portion into slots in said tubular member to provide a clearance between said cathode central portion and said slot to permit molten aluminum to pass into said tubular member.

16. The method in accordance with claim 1 wherein said molten aluminum reservoir is comprised of an electrical non-conductive material substantially inert with respect to electrolyte and molten aluminum.

17. A method of producing aluminum in an electrolytic cell containing alumina dissolved in an electrolyte, the method comprising the steps of:

(a) providing a molten salt electrolyte in an electrolytic cell having alumina dissolved therein, the electrolyte maintained at a temperature of less than 900° C., the cell having an anodic liner for containing said electrolyte, said liner having an anodic bottom and walls including at least one end wall extending upwardly from said bottom, said anodic liner being substantially inert with respect to said molten electrolyte, the molten electrolyte containing 1 to 30 wt. % undissolved alumina;

(b) providing a plurality of non-consumable anodes disposed substantially vertically in said electrolyte and a plurality of cathodes disposed vertically in said electrolyte, said anodes and said cathodes arranged in alternating relationship, said anodes electrically connected to said anodic liner, the liner and walls comprised of an Ni—Cu—Fe alloy;

(c) passing an electric current at a current density in the range of 0.1 to 1.5 A/cm$^2$through said anodic liner to said anodes, through said electrolyte to said cathodes, depositing aluminum on said cathodes, and generating oxygen bubbles at the anodes and said anodic liner, said bubbles stirring said electrolyte and maintaining said undissolved alumina in suspension;

(d) collecting molten aluminum from said cathodes in a tubular member positioned underneath said cathodes, said tubular member in liquid communication with each cathode to collect said molten aluminum therefrom, said tubular member electrically insulated from said anodic bottom; and (e) delivering molten aluminum through said tubular member to a molten aluminum reservoir, said molten aluminum collected from said cathodes and delivered to said reservoir while avoiding contact of the molten aluminum with said anodic bottom.

18. The method in accordance with claim 17 including operating said cell to maintain said electrolyte in a temperature range of about 660° to 800° C.

19. The method in accordance with claim 17 including using an electrolyte comprised of one or more alkali metal fluorides.

20. The method in accordance with claim 17 wherein undissolved alumina has a particle size in the range of 1 to 100 $\mu$m.

21. The method in accordance with claim 17 wherein said Ni—Cu—Fe alloy is comprised of 15 to 60 wt. % Ni, 27 to 70 wt. % Cu, the balance consisting essentially of Fe.

22. The method in accordance with claim 17 wherein said Ni—Cu—Fe alloy is comprised of 25 to 48 wt. % Ni, 45 to 70 wt. % Cu, the balance consisting essentially of Fe.

23. The method in accordance with claim 17 including passing an electric current through said cell at a current density in the range of 0.5 to 1.5 A/cm$^2$.

24. The method in accordance with claim 17 including using cathodes selected from the group consisting of titanium diboride, zirconium boride, titanium carbide, titanium and zirconium carbide.

25. The method in accordance with claim 17 wherein anodic bottom has two sides sloped downwardly towards said tubular member and said tubular member is insulated from said anodic bottom using an electrical insulating material substantially non-reactive with said molten electrolyte.

26. The method in accordance with claim 17 wherein said electrical insulating material is selected from the group consisting of alumina and boron nitride.

27. The method in accordance with claim 17 wherein said tubular member is comprised of $TiB_2$.

28. The method in accordance with claim 17 including fitting said central portion into slots in said tubular member to provide clearance between said cathode central portion to pelmit molten aluminum to pass into said tubular member.

29. The method in accordance with claim 17 wherein said molten aluminum reservoir is comprised of an electrical non-conductive material substantially inert with respect to electrolyte and molten aluminum.

30. A system for producing aluminum in an electrolytic cell containing alumina dissolved in an electrolyte, the system comprised of:

(a) an electrolytic cell having an anodic liner for containing a molten salt electrolyte having alumina dissolved therein, said liner having an anodic bottom and walls including at least one end wall extending upwardly from said bottom, said anodic liner being substantially inert with respect to said molten electrolyte;

(b) a plurality of non-consumable anodes disposed substantially vertically in said electrolyte in said cell and a plurality of cathodes disposed vertically in said electrolyte, said anodes and said cathodes arranged in alternating relationship, said anodes electrically connected to said anodic liner;

(c) means for passing an electric current through said anodic liner to said anodes, through said electrolyte to said cathodes in response to passing electric current through said electrolyte, depositing aluminum on said cathodes, and generating oxygen bubbles at the anodes and said anodic liner, said bubbles stirring said electrolyte;

(d) a tubular member positioned underneath said cathodes for collecting molten aluminum from said cathodes, said tubular member in liquid communication with each cathode to collect said molten aluminum therefrom while excluding electrolyte; and (e) a molten aluminum reservoir located substantially opposite said anodes and cathodes in fluid communication with said tubular member for receiving molten aluminum delivered from said tubular member, said tubular member adapted to collect said molten aluminum from said cathodes to deliver said molten aluminum to said reservoir while avoiding contact of the molten aluminum with said anodic bottom.

31. The system in accordance with claim 30 wherein at least one of the anodes and anodic liner are comprised of an Ni—Cu—Fe alloy.

32. The system in accordance with claim 30 wherein the anodes and anodic liner are comprised of Ni—Cu—Fe alloy having 15 to 60 wt. % Ni, 27 to 70 wt. % Cu, the balance comprising Fe, incidental elements and impurities.

33. The system in accordance with claim 30 wherein the anodes and anodic liner are comprised of Ni—Cu—Fe alloy having 25 to 48 wt. % Ni, 45 to 70 wt. % Cu, the balance comprising Fe, incidental elements and impurities.

34. The system in accordance with claim 30 wherein said cathodes are comprised of a material selected from the group consisting of titanium diboride, zirconium boride, titanium carbide, titanium and zirconium carbide.

35. The system in accordance with claim 30 wherein said tubular member is insulated from said anodic bottom using an electrical insulating material substantially non-reactive with said molten electrolyte.

36. The system in accordance with claim 35 wherein said insulating material is selected from the group consisting of alumina and boron nitride.

37. The system in accordance with claim 30 wherein said cell is designed to operate with an electrolyte containing 2 to 30 wt. % undissolved alumina.

38. The system in accordance with claim 30 wherein said electrolyte is designed to operate at a temperature less than 900° C.

* * * * *